US011396042B1

(12) United States Patent
Lee et al.

(10) Patent No.: US 11,396,042 B1
(45) Date of Patent: Jul. 26, 2022

(54) SERIAL MULTI-CAVITY HIGH PRESSURE CASTING APPARATUS AND HIGH PRESSURE CASTING METHOD USING THE SAME

(71) Applicants: HYUNDAI MOTOR COMPANY, Seoul (KR); KIA CORPORATION, Seoul (KR)

(72) Inventors: Cheol-Ung Lee, Hwaseong-si (KR); Ji-Yong Lee, Seoul (KR); Dae-Ho Lee, Busan (KR); Seong-Jun Lim, Ulsan (KR); Hyo-Moon Joo, Seoul (KR); Cheon-Hee Kim, Ulsan (KR); Sung-Hyun Kwon, Ulsan (KR); Yoon-Ki Lee, Suwon-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/501,452

(22) Filed: Oct. 14, 2021

(30) Foreign Application Priority Data

Jul. 9, 2021 (KR) ..... 10-2021-0090189

(51) Int. Cl.
*B22D 17/22* (2006.01)
*B22D 17/20* (2006.01)
*B22D 17/10* (2006.01)

(52) U.S. Cl.
CPC ..... *B22D 17/22* (2013.01); *B22D 17/10* (2013.01); *B22D 17/2023* (2013.01); *B22D 17/2076* (2013.01)

(58) Field of Classification Search
CPC .... B22D 17/22; B22D 17/10; B22D 17/2023; B22D 17/2076; B22D 17/2236; B22D 17/2272; B22D 17/24
See application file for complete search history.

(56) References Cited

U.S. PATENT DOCUMENTS

| | | | |
|---|---|---|---|
| 5,730,204 | A | 3/1998 | Shimmell |
| 2007/0184140 | A1 | 8/2007 | Kuzumi |

FOREIGN PATENT DOCUMENTS

| | | | |
|---|---|---|---|
| JP | 2001-321887 | A | 11/2001 |
| JP | 3225974 | B2 | 11/2001 |
| JP | 3481614 | B1 | 12/2003 |
| JP | 2004-249538 | A | 9/2004 |
| JP | 5552780 | B2 | 7/2014 |
| KR | 2006-0111690 | A | 10/2006 |
| KR | 2013-0032282 | A | 4/2013 |

*Primary Examiner* — Kevin P Kerns
*Assistant Examiner* — Steven S Ha
(74) *Attorney, Agent, or Firm* — McDonnell Boehnen Hulbert & Berghoff LLP

(57) ABSTRACT

A serial multi-cavity high pressure casting apparatus includes a three stage mold comprising a fixed mold, an operation mold, and a medium mold disposed between the fixed mold and the operation mold, a main sleeve penetrating a lower portion of the fixed mold, and having molten metal injected thereinto, a main runner formed to extend upward from the main sleeve, an auxiliary sleeve branched to both directions from the main runner, an auxiliary runner formed to extend upward from each of both ends of the auxiliary sleeve and connected to each of a first cavity formed between the fixed mold and the medium mold, and a second cavity formed between the medium mold and the operation mold, and a sleeve core disposed on a lower portion of the medium mold, and having the main sleeve, the main runner, and the auxiliary sleeve inserted thereinto.

14 Claims, 8 Drawing Sheets

SERIAL MULTI-CAVITY HIGH PRESSURE CASTING APPARATUS AND HIGH PRESSURE CASTING METHOD USING THE SAME

CROSS REFERENCE TO RELATED APPLICATIONS

This application claims priority to Korean Patent Application No. 10-2021-0090189, filed on Jul. 9, 2021, which is incorporated herein by reference in its entirety.

BACKGROUND

Field of the Disclosure

The present disclosure relates to a high pressure casting apparatus and a high pressure casting method capable of producing a casting product twice in one mold.

Description of Related Art

Assuming that one product is conventionally produced in one mold when a product is produced by a high pressure casting, to produce two products in one mold, 1) a parallel multi-cavity structure, 2) an increase in a casting area, and 3) an increase in the tonnage of a high pressure casting machine due to an increase in a mold-clamping force should be applied.

A mold-opening force (P) is a value obtained by multiplying a casting pressure (p) by a casting area (A), and the mold-opening force is proportional to the casting area.

A general casting pressure has a slight difference according to products but has about 600 to 800 bar, the casting pressure does not greatly vary even if the size of the mold or the size of the product is changed. Instead, as the casting area increases, the mold-opening force that opens the mold increases and a high pressure casting machine with a mold-opening force larger than the mold-opening force such that the mold is not opened is selected. For example, a 2-cavity casting method compared to a projection area of a 1-cavity casting method requires a projection area of about 1.8 to 2 times. In other words, when a 500 t high pressure casting machine is required to produce a product of the 1-cavity casting method, a 1,000 t high pressure casting machine is arithmetically required to produce the 2-cavity casting product.

For example, Japanese Patent Application Laid-Open No. 2001-321887 discloses that two multi-cavity casting methods have been designed by the three stage mold (fixed/medium/operation) and each cavity has been filled using two sleeves and the plunger.

The method may simultaneously produce two or more products with the same tonnage of the high pressure casting machine, but has no choice but to fill each sleeve/the plunger with molten metal, and therefore, there is no choice but to use a method for sequentially injecting the molten metal using a ladle in one melting furnace, or simultaneously injecting the molten metal in each of two melting furnaces. The former increases a cycle time, and the latter increases an investment cost due to the construction of an additional melting facility, thereby affecting productivity and product costs.

The contents described in Description of Related Art are to help the understanding of the background of the present disclosure, and may include what is not previously known to those skilled in the art to which the present disclosure pertains.

SUMMARY

The present disclosure has been made in an effort to solve the above problem associated with the related art, and an object of the present disclosure is to provide a serial multi-cavity high pressure casting apparatus and a high pressure casting method using the same, which may produce a product twice as much as the convention in one mold without increasing a mold-clamping force of the high pressure casting apparatus.

According to one aspect of the present disclosure, a serial multi-cavity high pressure casting apparatus includes a three stage mold including a fixed mold, an operation mold, and a medium mold disposed between the fixed mold and the operation mold, a main sleeve penetrating a lower portion of the fixed mold, and having molten metal injected thereinto, a main runner formed to extend upward from the main sleeve, an auxiliary sleeve branched to both directions from the main runner, an auxiliary runner formed to extend upward from each of both ends of the auxiliary sleeve and connected to each of a first cavity formed between the fixed mold and the medium mold, and a second cavity formed between the medium mold and the operation mold, and a sleeve core disposed on a lower portion of the medium mold, and having the main sleeve, the main runner, and the auxiliary sleeve inserted thereinto.

Further, a pair of bisected sleeve cores are provided, and the main sleeve, the main runner, and the auxiliary sleeve are inserted into a core cavity formed between the pair of sleeve cores.

Furthermore, each of the auxiliary runners connected to the first cavity and the second cavity is divided into a plurality of auxiliary runners from the auxiliary sleeve, and the first cavity and the second cavity are formed as many as each of the auxiliary runners is divided.

Alternatively, the serial multi-cavity high pressure casting apparatus may further include a pair of core cylinders coupled to side surfaces of the pair of sleeve cores, respectively, and coupled to both side surfaces of the medium mold perpendicular to a longitudinal direction of the main sleeve, to operate the pair of sleeve cores by a hydraulic pressure in a direction perpendicular to the longitudinal direction of the main sleeve.

Further, the serial multi-cavity high pressure casting apparatus may further include a pair of hydraulic cutters coupled to an upper end of the medium mold, and each of the hydraulic cutters including a cutting blade extending toward the sleeve core inside the medium mold to move the pair of hydraulic cutting blades upward or downward by a hydraulic pressure.

Therefore, when the cutting blade moves downward by the pair of hydraulic cutters, the pair of cutting blades cut the auxiliary sleeve.

In particular, the pair of cutting blades cut each of symmetric points with respect to a branched point where the auxiliary sleeve is branched from the main runner.

Meanwhile, the serial multi-cavity high pressure casting apparatus may further include a sliding shoe coupled to a lower side of the medium mold to guide a movement operation of the medium mold.

Further, a guide rail extending toward the operation mold and formed with a guide hole in a longitudinal direction is coupled to one side of the fixed mold, and a stopper inserted into the guide hole protrudes and is coupled to one side of the medium mold.

Further, the serial multi-cavity high pressure casting apparatus may further include a hydraulic fastener coupled to one side of the operation mold and to one side of the medium mold to fasten the operation mold to the medium mold.

Next, a high pressure casting method using a serial multi-cavity high pressure casting apparatus according to one aspect of the present disclosure includes injecting molten metal into the main sleeve of the serial multi-cavity high pressure casting apparatus and filling the molten metal in the first cavity and the second cavity by moving a plunger provided in the main sleeve forward.

The high pressure casting method may further include opening the first cavity by operating the medium mold and the operation mold when the molten metal is filled by the filling of the molten metal and then the molten metal is solidified to complete the casting and moving a pair of sleeve cores toward the pair of core cylinders by operating the pair of core cylinders.

Further, the serial multi-cavity high pressure casting apparatus includes a pair of hydraulic cutters coupled to an upper end of the medium mold, and each of the hydraulic cutters including a cutting blade disposed to extend toward the sleeve core inside the medium mold to move the cutting blade upward or downward by the hydraulic pressure, and the high pressure casting method may further include cutting the auxiliary sleeve by operating the pair of hydraulic cutters.

The serial multi-cavity high pressure casting apparatus further includes the hydraulic fastener coupled to one side of the operation mold and to one side of the medium mold to fasten the operation mold to the medium mold, and the high pressure casting method may further include releasing the constraint of the operation mold and the medium mold by operating a hydraulic fastener and opening the second cavity by operating the operation mold.

The present disclosure may minimize the increase in the projection area by disposing the product in series other than the conventional parallel multi-cavity high pressure casting method, and improve the productivity twice without increasing the tonnage of the high pressure casting machine.

In other words, the present disclosure simultaneously injects the molten metal into the multi-cavity, thereby not increasing the cycle time, and does not inject the molten metal into each of the multi-cavity and therefore does not increase the investment cost due to the construction of the additional melting facility, thereby improving the productivity and reducing the cost.

DETAILED DESCRIPTION

To fully understand the present disclosure, the operational advantages of the present disclosure, and the object achieved by the practice of the present disclosure, reference should be made to the accompanying drawings illustrating preferred exemplary embodiments of the present disclosure and the contents described in the accompanying drawings.

In describing preferred exemplary embodiments of the present disclosure, a description of well-known techniques or repetitive descriptions that may unnecessarily obscure the gist of the present disclosure will be reduced or omitted.

Figure 1:
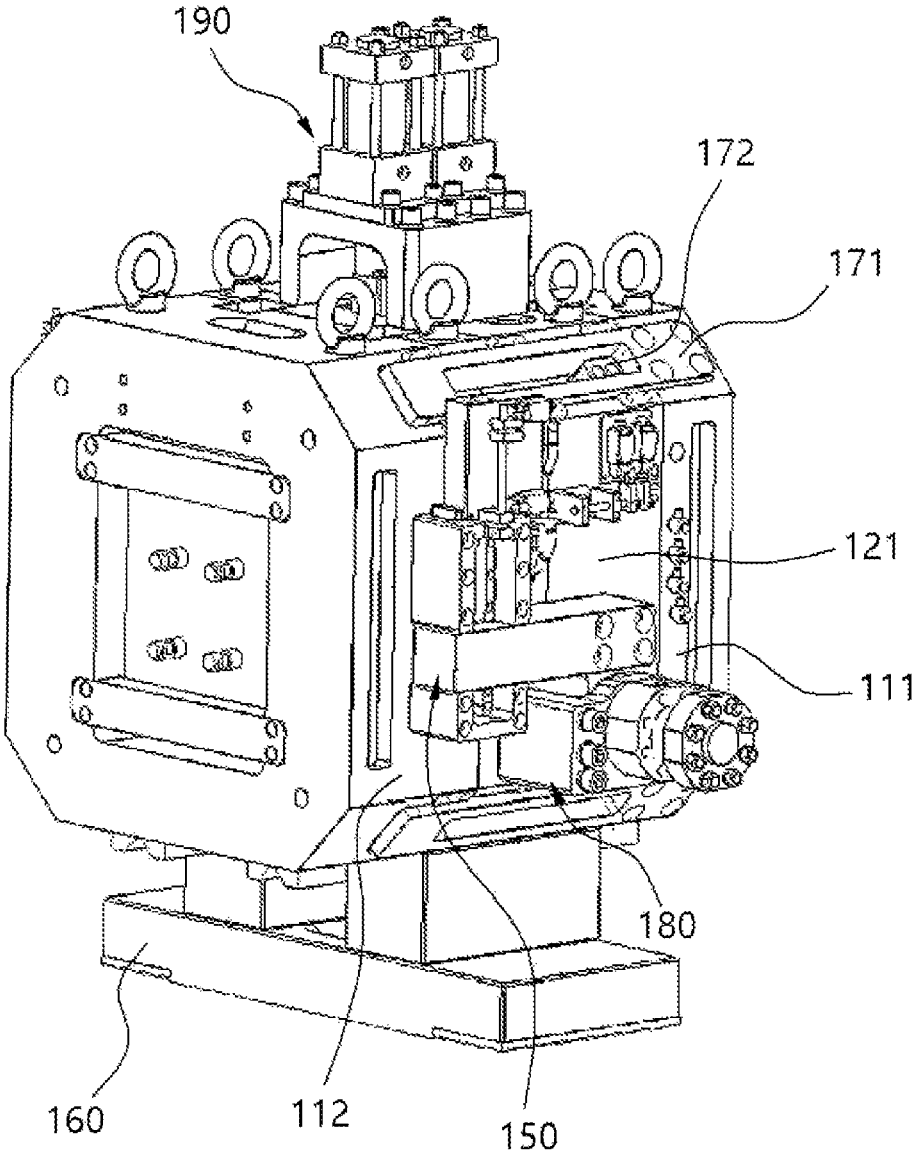
FIG. 1 illustrates a serial multi-cavity high pressure casting apparatus according to the present disclosure.
Figure 2:
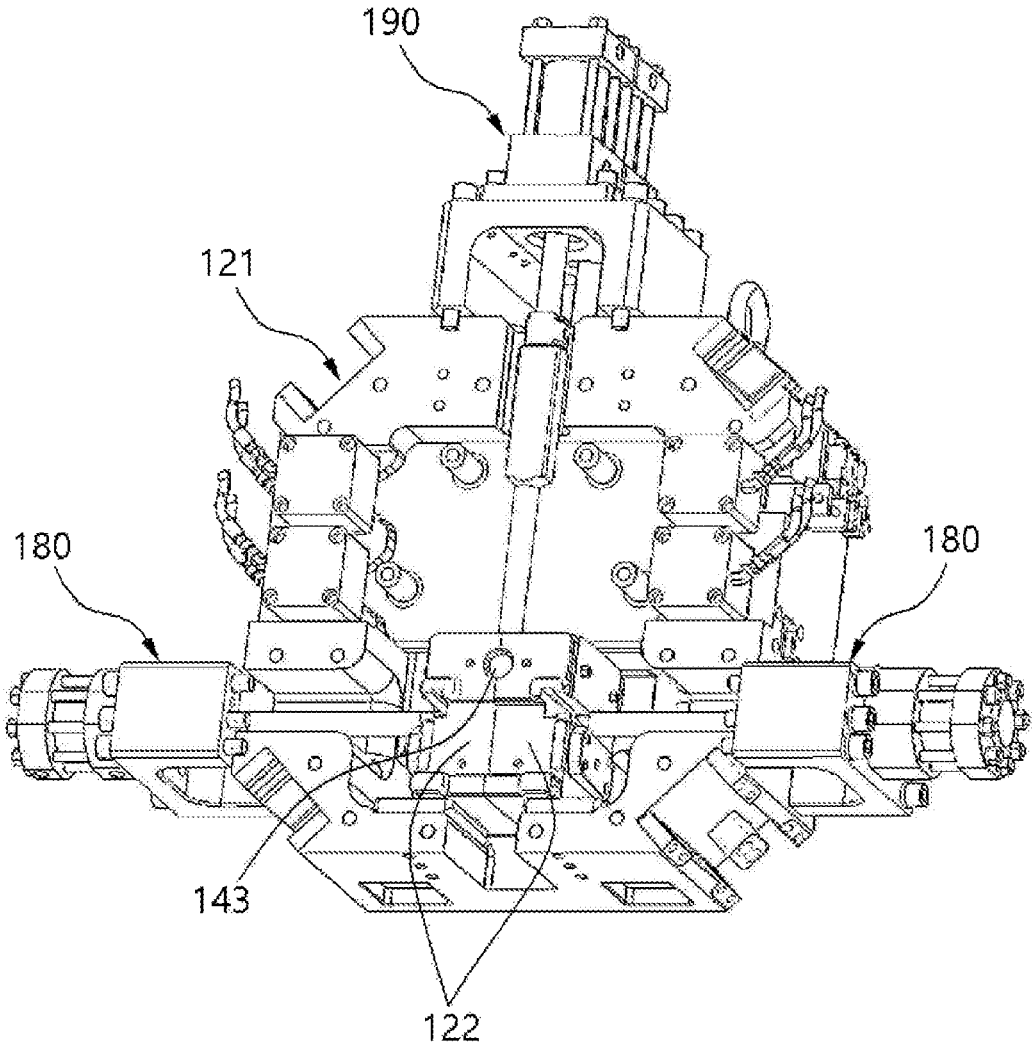
FIG. 2 illustrates a cross-sectional shape of FIG. 1.

FIG. 1 illustrates a serial multi-cavity high pressure casting apparatus according to the present disclosure and FIG. 2 illustrates a cross-sectional shape of FIG. 1. Further, FIGS. 3 to 7 illustrate the serial multi-cavity high pressure casting apparatus according to the present disclosure partially and schematically for explaining a specific configuration and operation thereof.

Hereinafter, a serial multi-cavity high pressure casting apparatus according to an exemplary embodiment of the present disclosure will be described with reference to FIGS. 1 to 7.

The present disclosure relates to a technology that may minimize an increase in a projection area by disposing a product in series other than the conventional parallel multi-cavity high pressure casting method, and improve productivity twice without increasing the tonnage of a high pressure casting machine.

To this end, a serial multi-cavity high pressure casting apparatus according to an exemplary embodiment of the present disclosure has a three stage mold structure in which a medium mold 121 is disposed between a fixed mold 111 and an operation mold 112, in which a first cavity C1 is formed between the fixed mold 111 and the medium mold 121, and a second cavity C2 is formed between the operation mold 112 and the medium mold 121.

A mold support device 130 has the mold support device at the fixed mold side coupled to the fixed mold 111 to support the fixed mold 111, and the mold support device at the operation mold side coupled to the operation mold 112 to support the operation mold 112, and at the same time, to operate the operation mold 112 toward the fixed mold 111 forward or backward.

For such a placement, support, and operation, a hydraulic fastener 150, a sliding shoe 160, a guide rail 171, a stopper 172, a core cylinder 180, a hydraulic cutter 190, or the like are provided, and for filling a first cavity C1 and a second cavity C2, a plunger P, a main sleeve 141, a main runner 142, an auxiliary sleeve 143, and an auxiliary runner 144 are constituted.

Figure 3:
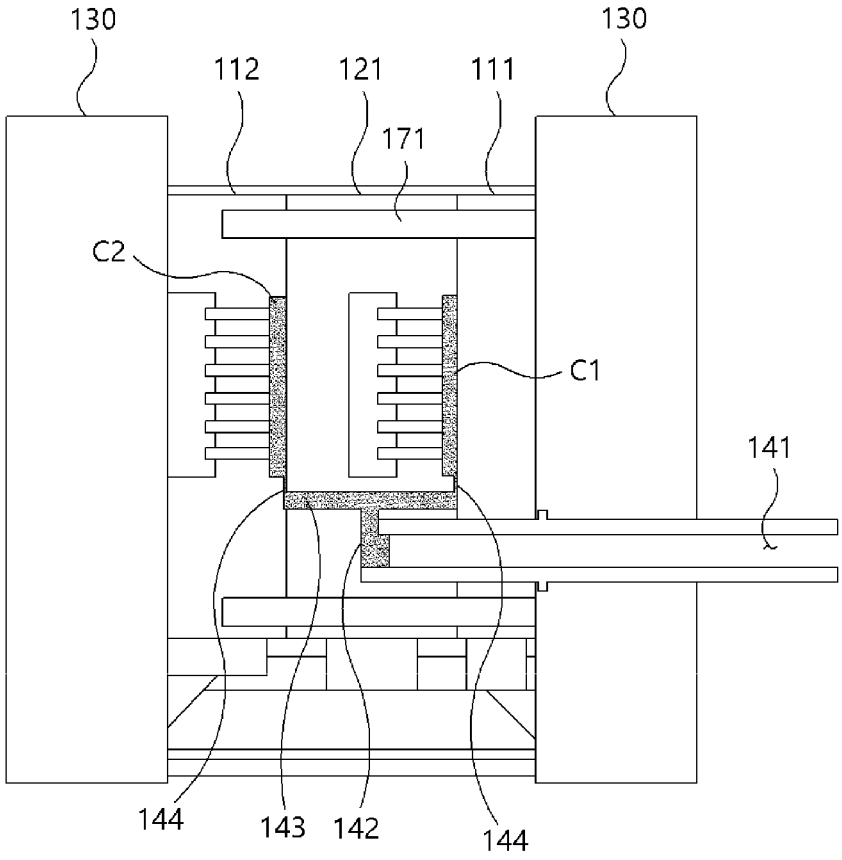
FIGS. 3, 4, 5, 6, and 7 illustrate the serial multi-cavity high pressure casting apparatus according to the present disclosure partially and schematically for explaining a specific configuration and operation thereof.
Figure 4:
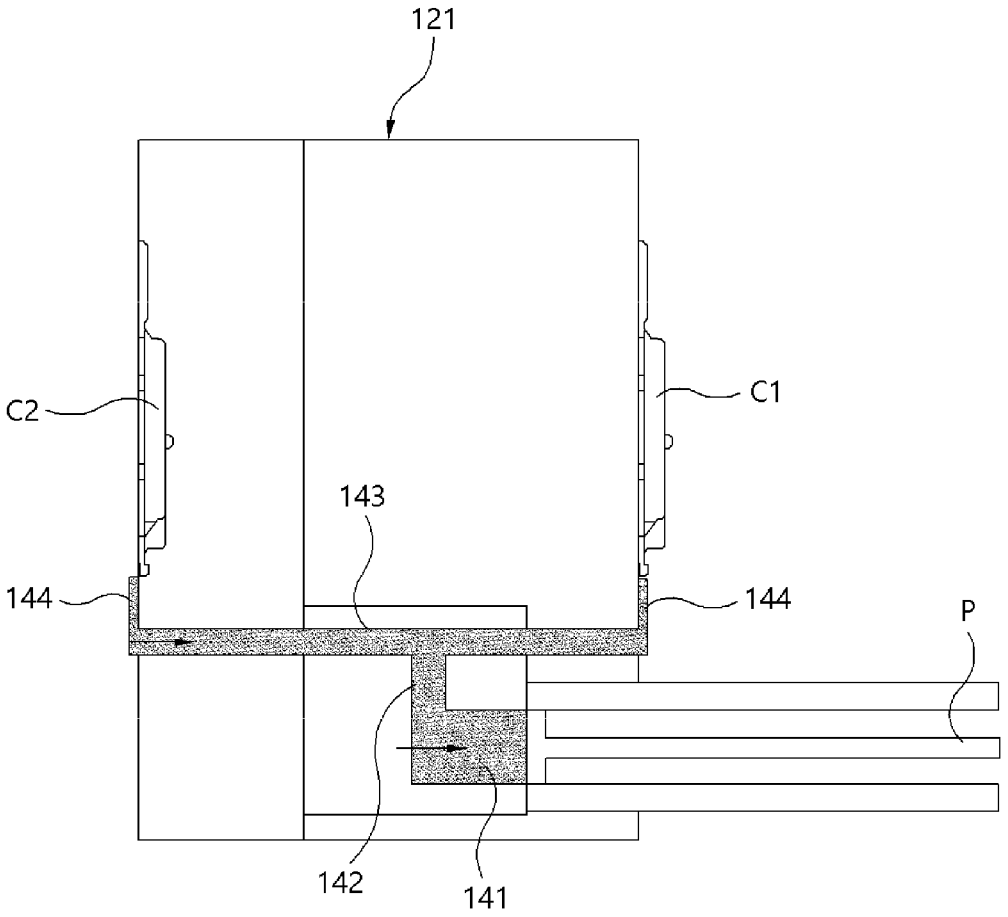

As illustrated in FIGS. 3 and 4, according to the present disclosure, one main sleeve 141 configured to inject molten metal is formed to penetrate a lower portion of the fixed mold 111 to extend to a lower side of the medium mold 121, and the plunger P is provided in the main sleeve 141 to pressurize the injected molten metal such that the molten metal is injected into the cavity.

According to the present disclosure, for filling a double cavity, the main runner 142 is formed to extend upward from the main sleeve 141, and the auxiliary sleeve 143 branched to both directions from an upper end of the main runner 142 is formed.

Further, the auxiliary runners 144 are formed upward from the auxiliary sleeves 143 of both sides, respectively, and therefore, each auxiliary runner 144 communicates with the first cavity C1 and the second cavity C2.

Therefore, two products may be produced by simultaneously filling two cavities C1, C2 with the molten metal injected by one main sleeve 141.

Furthermore, each auxiliary runner 144 is formed in a double, and each of the first cavity C1 and the second cavity C2 may be formed as a double cavity. In this case, molten metal is injected from a total of four auxiliary runners to fill four cavities such that four products may be produced.

Here, after the molten metal is filled and solidified, the product may not be taken out due to the shape of the auxiliary sleeve 143, and to solve such a problem, the present disclosure includes bisected sleeve cores 122 inside a lower portion of the medium mold 121, and the core cylinder 180 is connected to each of the bisected sleeve cores 122 and configured such that the bisected sleeve core 122 may be away from each other and opened by the hydraulic pressure of the core cylinder 180.

Figure 5:
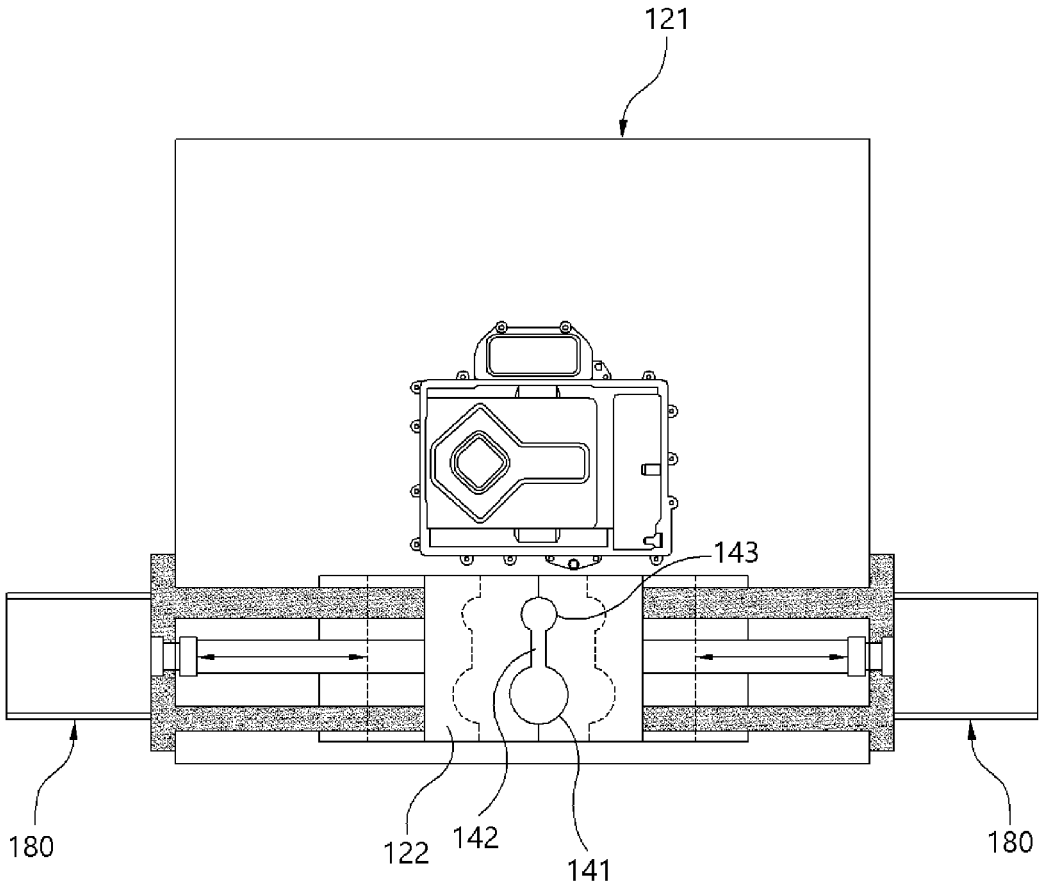

In other words, as illustrated in FIGS. 2 and 5, a pair of sleeve cores 122 are formed with core cavities with the shape corresponding to the main sleeve 141, the main runner 142, and the auxiliary sleeve 143 upon engagement, and therefore, becomes the form into which the main sleeve 141, the main runner 142, and the auxiliary sleeve 143 are inserted into the core cavity upon engagement.

In other words, the main sleeve 141 is formed to the inside of the engaged sleeve core 122, the main runner 142 is connected to the main sleeve 141 to be formed between the sleeve cores 122, and the auxiliary sleeve 143 branched from the main runner 142 is formed to penetrate the sleeve core 122.

Further, the end of the auxiliary sleeve 143 is formed outside the sleeve core 122, and therefore, the auxiliary runner 144 is formed.

As illustrated, a core cylinder 180 is coupled to both sides of the medium mold 121 perpendicular to a longitudinal direction of the main sleeve 141, and each one end thereof is connected to the sleeve core 122 to open the sleeve core 122 to both sides of the medium mold 121 perpendicular to the longitudinal direction of the main sleeve 141.

Figure 6:
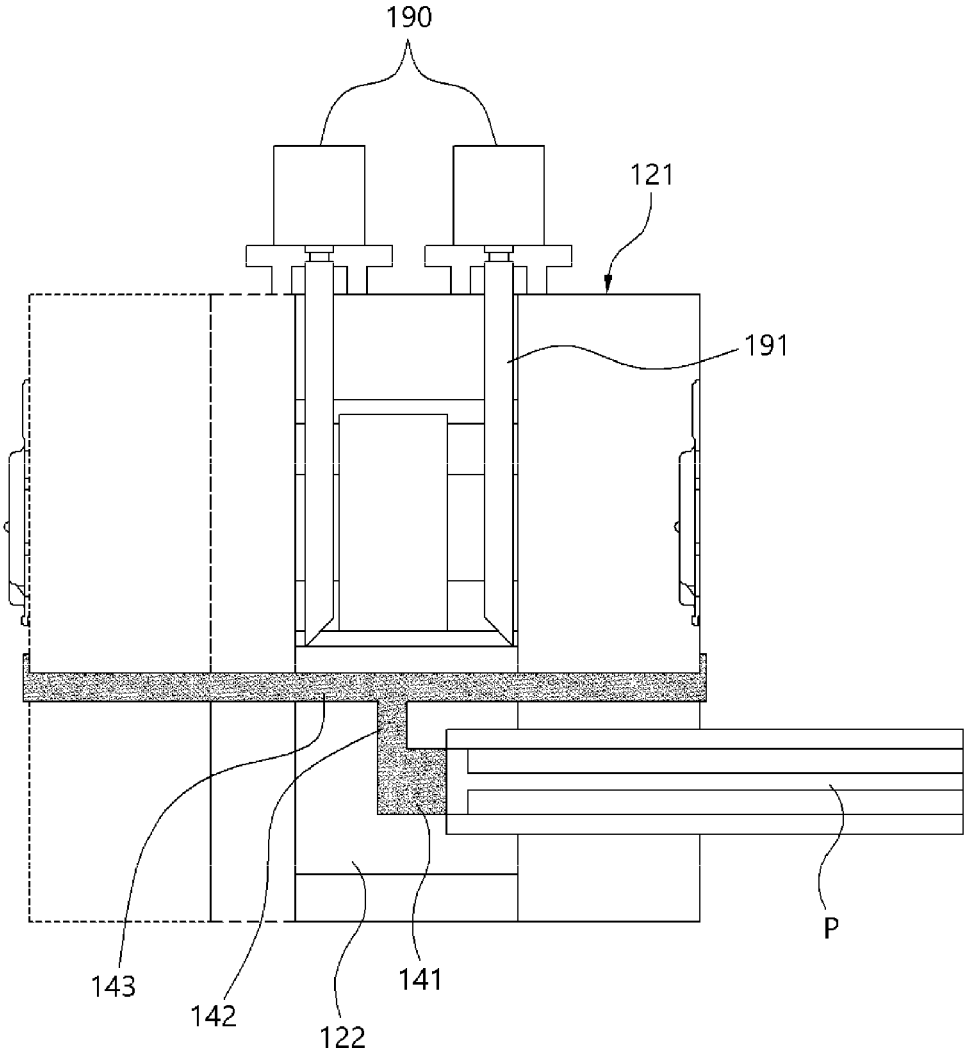

At this time, as illustrated in FIGS. 1 and 6, the auxiliary sleeve 143 may be cut after the molten metal is solidified by a pair of hydraulic cutters 190 coupled to an upper end of the medium mold 121.

In other words, the sleeve core 122 is opened, a cutting blade 191 connected to each of the pair of hydraulic cutter 190 operated by the hydraulic pressure to move upward or downward is formed toward the sleeve core 122 from the upper end of the medium mold 121, and after the sleeve core 122 is opened, the cutting blade 191 moves downward to cut the auxiliary sleeve 143.

The cutting blade 191 is disposed at a position of cutting each of the symmetric points of the auxiliary sleeve 143 with respect to the branched point of the auxiliary sleeve 143.

Therefore, the sleeve core 122 is opened and the auxiliary sleeve 143 is cut by the hydraulic cutter 190 before the solidification is completed, and the mold is opened such that the product may be taken out after avoiding an under-cut shape of the casting product to complete the casting.

Figure 7:
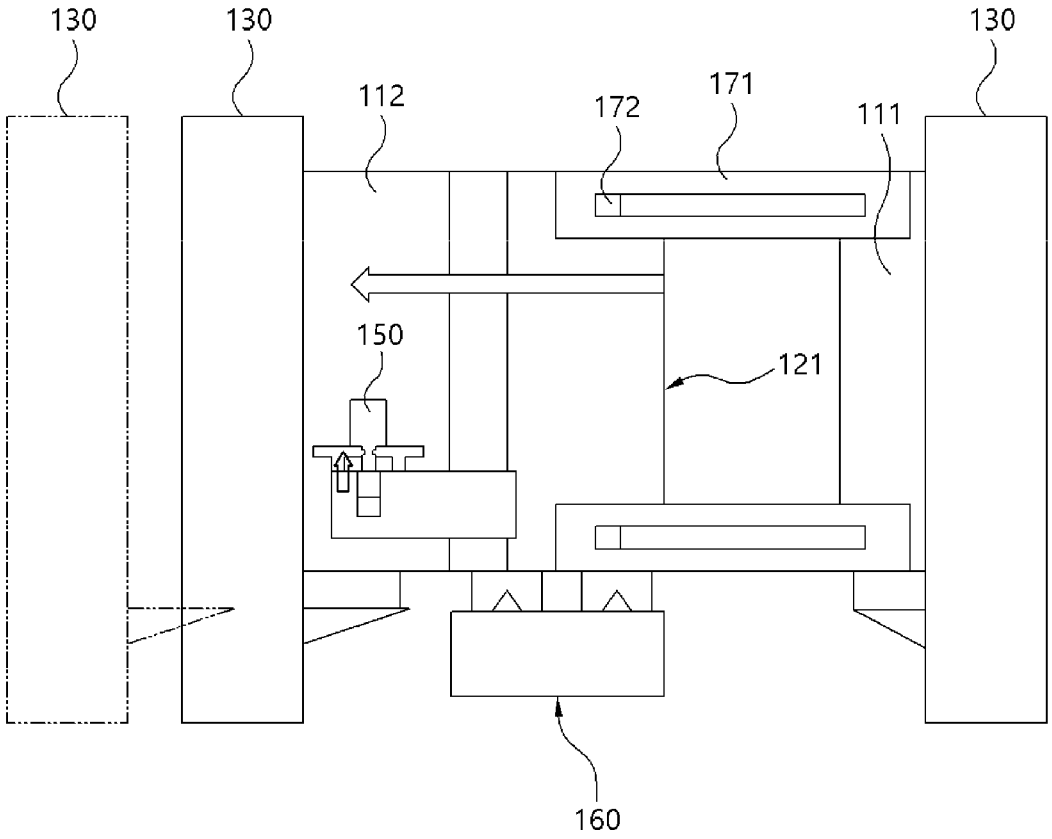

Next, as illustrated in FIG. 7, the lower side of the medium mold 121 is coupled with the sliding shoe (guide shoe) 160 to prevent the conduction of the medium mold 121 upon the mold-opening. In other words, the mold support device 130 at the operation mold 112 side moves on a movable rail (not illustrated), and the sliding shoe 160 to which a low friction material movable on the movable rail is applied is mounted, thereby facilitating the movement in a direction in which the mold of the medium mold 121 is opened or closed despite the increased weight of the mold.

Further, to prevent the medium mold 121 from being separated upon opening in a state where the medium mold 121 is coupled to the fixed mold 111, the medium mold 121 is coupled to one side of the fixed mold 111 and extends toward the operation mold 112, and the guide rail 171 having a guide hole formed in a longitudinal direction is mounted. Further, the stopper 172 inserted into the guide hole of the guide rail 171 is coupled to protrude from one side of the medium mold 121, and therefore the stopper 172 is blocked by the guide rail 171 when the mold is opened, thereby preventing the medium mold 121 from being separated.

A pair of guide rail 171 and stopper 172 may be formed on the upper and lower portions of the serial multi-cavity high pressure casting apparatus.

Further, the operation mold 112 may be engaged and may perform the mold assembly and the mold-opening operation in a state of being coupled to the medium mold 121, and additionally, may be separated from the medium mold 121 to perform the mold-opening operation.

To this end, the hydraulic fastener 150 including a locking block coupled to one side of the operation mold 112 and one side of the medium mold 121 together is constituted, and the operation mold 112 may be separated from the medium mold 121 due to the hydraulic release of the hydraulic fastener 150.

As described above, it is possible to secure operational stability by sequentially opening the mold.

Furthermore, the present disclosure makes the mold structure compact to secure a taken-out space.

In other words, the conventional mold has the mold structure in which the mold and the holder are assembled in consideration of durability and maintainability, in which the mold structure is complicated and the size thereof is increased by constituting the separate components of the mold and the holder.

However, there is a need for minimizing the size of the mold because the taken-out space is insufficient if the three stage mold is opened when the thickness of the mold is increased, and the present disclosure may drive the optimization of the size of the mold through the mold design standardization and the structural analysis, thereby deleting a holder part including a pocket part.

In other words, it is possible to minimize the size of the mold by the integrated mold structure (holderless), thereby securing the taken-out space of the product.

Figure 8:
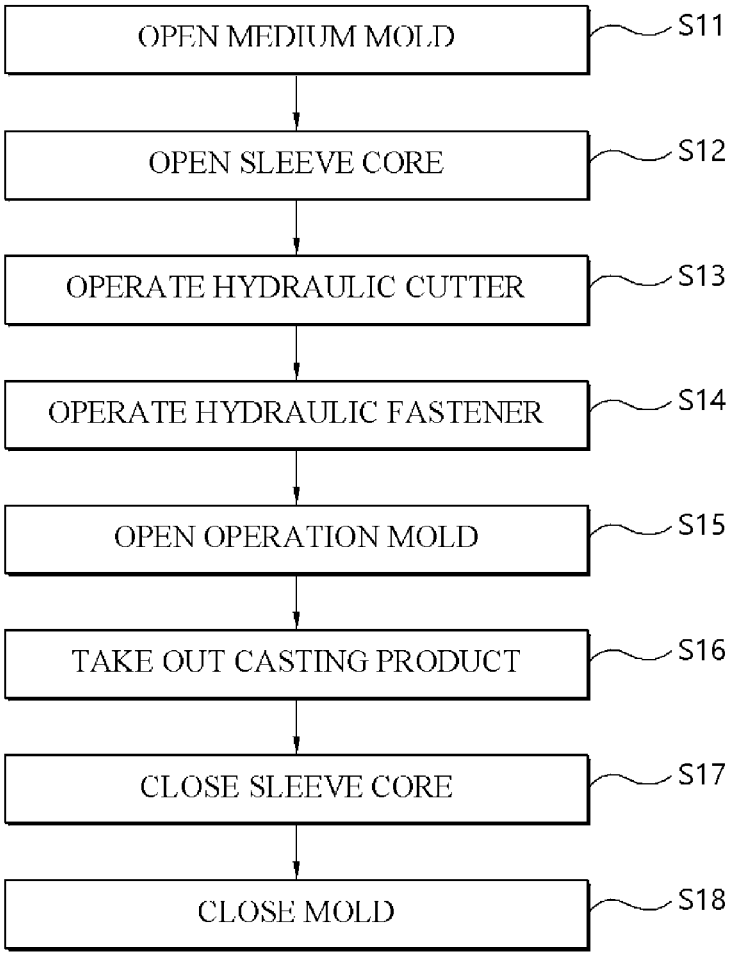
FIG. 8 sequentially illustrates a high pressure casting method using the serial multi-cavity high pressure casting apparatus according to the present disclosure.

A high pressure casting method using the serial multi-cavity high pressure casting apparatus having the above configuration will be described with reference to FIG. 8.

First, the molten metal is injected into the main sleeve 141 in a state where the fixed mold 111, the medium mold 121, and the operation mold 112 are engaged, and the molten metal is filled in the first cavity C1 and the second cavity C2 by moving the plunger P forward through the main sleeve 141, the main runner 142, and the auxiliary sleeve 143, and the auxiliary runner 144.

Further, when the molten metal is filled and then solidified to complete the casting, the medium mold 121 performs the opening operation at S11. In other words, the operation mold 112 coupled to the medium mold 121 moves backward together and therefore, the first cavity C1 is opened.

Then, the sleeve core 122 performs the opening operation by the operation of the core cylinder 180 at S12, and the hydraulic cutter is operated at S13 to cut the auxiliary sleeve 143.

Further, by releasing the hydraulic fastener 150 at S14, when the locking block is opened, the operation mold 112 is released from the constraint of the medium mold 121 to control the operation mold to be open at S15.

As described above, the casting product is taken out from the first cavity C1 and the second cavity C2 in a state where the second cavity C2 is also opened at S16.

Then, the sleeve core 122 is also controlled to be closed again by the operation of the core cylinder 180 at S17, and the mold is sequentially closed at S18.

The present disclosure has been described above with reference to the exemplary drawings, but is not limited to the described exemplary embodiment, and it will be apparent to those skilled in the art that various modifications and changes are made without departing the spirit and scope of the present disclosure. Therefore, the modified examples or the changed examples are included in the claims of the present disclosure, and the scope of the present disclosure should be interpreted based on the appended claims.

The invention claimed is:

1. A serial multi-cavity high pressure casting apparatus comprising:

a three stage mold comprising a fixed mold, an operation mold, and a medium mold positioned between the fixed mold and the operation mold;

a main sleeve penetrating a lower portion of the fixed mold, the main sleeve having molten metal injected thereinto;

a main runner extending upward from the main sleeve;

an auxiliary sleeve extending outwardly in both directions from the main runner;

an auxiliary runner extending upward from each end of the auxiliary sleeve, wherein a first auxiliary runner is connected to a first cavity formed between the fixed mold and the medium mold, and a second auxiliary runner is connected to a second cavity formed between the medium mold and the operation mold; and a sleeve core positioned on a lower portion of the medium mold, the sleeve core having the main sleeve, the main runner, and the auxiliary sleeve inserted thereinto.

2. The serial multi-cavity high pressure casting apparatus of claim 1, further comprising a pair of bisected sleeve cores; and wherein the main sleeve, the main runner, and the auxiliary sleeve are inserted into a core cavity formed between the pair of bisected sleeve cores.

3. The serial multi-cavity high pressure casting apparatus of claim 2, wherein each of the first and second auxiliary runners is divided into a plurality of auxiliary runners from the auxiliary sleeve; and wherein the first cavity and the second cavity are formed as many times as each of the auxiliary runners is divided.

4. The serial multi-cavity high pressure casting apparatus of claim 2, further comprising a pair of core cylinders coupled to side surfaces of the pair of sleeve cores, respectively, the pair of core cylinders being coupled to both side surfaces of the medium mold perpendicular to a longitudinal direction of the main sleeve to operate the pair of sleeve cores by a hydraulic pressure in a direction perpendicular to the longitudinal direction of the main sleeve.

5. A high pressure casting method using a serial multi-cavity high pressure casting apparatus, the method comprising:

injecting molten metal into the main sleeve of the serial multi-cavity high pressure casting apparatus of claim 4; and filling the molten metal in the first cavity and the second cavity by moving a plunger provided in the main sleeve forward.

6. The high pressure casting method of claim 5, further comprising:

opening the first cavity by operating the medium mold and the operation mold when the molten metal is filled by the filling of the molten metal, and then the molten metal is solidified to complete the casting; and moving the pair of sleeve cores toward the pair of core cylinders by operating the pair of core cylinders.

7. The high pressure casting method of claim 6, wherein the serial multi-cavity high pressure casting apparatus further comprises:

a pair of hydraulic cutters coupled to an upper end of the medium mold, the pair of hydraulic cutters each comprising a cutting blade extending toward the sleeve core inside the medium mold to move the cutting blade upward or downward by the hydraulic pressure; and wherein the method further comprises cutting the auxiliary sleeve by operating the pair of hydraulic cutters.

8. The high pressure casting method of claim 7, wherein the serial multi-cavity high pressure casting apparatus further comprises:

a hydraulic fastener coupled to one side of the operation mold and to one side of the medium mold to fasten the operation mold to the medium mold;

wherein the method further comprises releasing the constraint of the operation mold and the medium mold by operating the hydraulic fastener; and opening the second cavity by the operation mold.

9. The serial multi-cavity high pressure casting apparatus of claim 2, further comprising a pair of hydraulic cutters coupled to an upper end of the medium mold, the pair of hydraulic cutters each comprising a cutting blade extending toward the sleeve core inside the medium mold to move the pair of hydraulic cutting blades upward or downward by a hydraulic pressure.

10. The serial multi-cavity high pressure casting apparatus of claim 9, wherein when each of the cutting blades moves downward by the pair of hydraulic cutters, the pair of cutting blades cut the auxiliary sleeve.

11. The serial multi-cavity high pressure casting apparatus of claim 10, wherein the pair of cutting blades cut each of symmetric points with respect to a branched point where the auxiliary sleeve extends from the main runner.

12. The serial multi-cavity high pressure casting apparatus of claim 2, further comprising a sliding shoe coupled to a lower side of the medium mold to guide movement of the medium mold.

13. The serial multi-cavity high pressure casting apparatus of claim 2, wherein a guide rail extending toward the operation mold and formed with a guide hole in a longitudinal direction is coupled to one side of the fixed mold; and wherein a stopper inserted into the guide hole protrudes and is coupled to one side of the medium mold.

14. The serial multi-cavity high pressure casting apparatus of claim 2, further comprising a hydraulic fastener coupled to one side of the operation mold and to one side of the medium mold to fasten the operation mold to the medium mold.

* * * * *